US005640825A

United States Patent [19]

Ehsani et al.

[11] Patent Number: 5,640,825

[45] Date of Patent: Jun. 24, 1997

[54] METHOD OF STRENGTHENING MASONRY AND CONCRETE WALLS WITH COMPOSITE STRAP AND HIGH STRENGTH RANDOM FIBERS

[76] Inventors: Mohammad R. Ehsani, 5630 E. Via Arbolada, Tucson, Ariz. 85715; Hamid Saadatmanesh, 5121 E. Paseo Del Bac, Tucson, Ariz. 85718

[21] Appl. No.: 387,136

[22] Filed: Feb. 10, 1995

Related U.S. Application Data

[63] Continuation-in-part of Ser. No. 226,495, Apr. 12, 1994, abandoned.

[51] Int. Cl.[6] ..... E04B 1/00

[52] U.S. Cl. ..... 428/408; 428/408

[58] Field of Search ..... 52/746.1; 156/71, 156/91, 92; 428/902, 408

[56] References Cited

U.S. PATENT DOCUMENTS 4,851,277 7/1989 Valkenburg et al. .

FOREIGN PATENT DOCUMENTS 0378232 7/1990 European Pat. Off. .

OTHER PUBLICATIONS

"Plastics Technology" by Robert Milby.

*Primary Examiner*—Creighton Smith
*Attorney, Agent, or Firm*—John R. Flanagan

[57] ABSTRACT

A method of strengthening a wall includes the steps of preparing a portion of a surface of a wall to be strengthened by cleaning the surface, providing a plurality of straps of flexible nonmetallic fiber composite material, and fixedly attaching the straps of nonmetallic fiber composite material to the wall portion along at least lengthwise portions of the straps and opposite end portions thereof by epoxy bonding the straps onto the surface. Also, the straps are impregnated with the epoxy in preparation for bonding the strap to the wall surface. Also, edge portions of the straps are fastened to an adjacent structure which supports the wall being strengthened so as to facilitate transfer of loads from the wall to the adjacent structure. Another method of strengthening a wall includes the steps of providing a mixture of randomly-oriented short fibers and liquid resin or adhesive matrix and applying the mixture to the surface of the wall. The mixture can be applied either by spraying or troweling the mixture onto the surface of the wall. The liquid resin or adhesive matrix is a material that cures fast so as to prevent the fibers from running with the liquid down the height of the wall surface.

40 Claims, 3 Drawing Sheets

METHOD OF STRENGTHENING MASONRY AND CONCRETE WALLS WITH COMPOSITE STRAP AND HIGH STRENGTH RANDOM FIBERS

CROSS-REFERENCE TO RELATED APPLICATION

This application is a continuation-in-part of U.S. application Ser. No. 08/226,495, filed Apr. 12, 1994 now abandoned.

BACKGROUND OF THE INVENTION

1. Field of the Invention

The present invention generally relates to masonry and concrete wall existing and new construction and, more particularly, is concerned with a method of strengthening, by using a composite fabric strap or a mixture of high strength random fibers and epoxy or the like, the masonry and concrete walls of existing construction having inadequate or no reinforcement and the masonry and concrete walls of new construction to permit an improved design.

2. Description of the Prior Art

As known to those skilled in the art, the majority of the existing masonry structures contain little or no steel reinforcement. These structures are referred to as Unreinforced Masonry (URM) structures. These walls are typically constructed with brick, hollow clay tile, or concrete masonry blocks. In addition, there are a large number of concrete walls with insufficient amounts of steel reinforcement. The latter can be cast-in-place or constructed as pre-cast modules of reinforced concrete walls which are tied together at the construction site (e.g. tilt-up walls and pre-cast concrete walls).

When the structures containing these walls are analyzed, these deficiencies (i.e. the lack of or insufficient amounts of steel reinforcement) are often identified. The presence of these deficiencies in existing construction requires that the walls be externally reinforced. Such is the case in seismic regions of the world, where a large number of these walls require strengthening.

Furthermore, in many frame structures, partition walls are used for division of the floor space. This type of construction is referred to as infill frame construction. Various types of solid or hollow bricks are placed within the plane of the frames to form a wall. In the event of an earthquake, these infill walls often fall apart and collapse, resulting in loss of life and property.

Yet a third category is the parapet wall around the perimeter of the roof of a building. These walls also often lack steel reinforcement and their collapse during earthquakes has been a major cause of loss of life and property.

It is therefore clear that there is a need for effective and economical techniques to strengthen these walls. Such techniques must increase the strength, stiffness, and ductility of the wall.

The methods commonly used to date for strengthening walls include the addition of a new reinforced concrete wall to one or both faces of the existing wall. The new walls include steel reinforcement which is tied to the surface(s) of the existing wall through anchor bolts. Then a layer of concrete (usually a few inches in thickness) is added or sprayed on top of the steel reinforcement. In essence, the old wall is sandwiched between the two new walls. This type of strengthening is not only time consuming, but it also results in a significant increase in the weight of the externally reinforced wall. Because the forces produced during an earthquake are proportional to the weight of the structure, this added mass results in larger forces being applied to the structure. Moreover, in many instances, the existing foundations of the structure cannot support the weight of the newly-added walls; this leads to further expenses to strengthen the foundation.

Consequently, an unfulfilled need still exists for effective and economical techniques to strengthen walls having inadequate or no reinforcement by increasing the strength, stiffness, and ductility of the walls.

SUMMARY OF THE INVENTION

The present invention provides a method of strengthening a masonry and/or concrete wall being designed to satisfy the aforementioned need. The strengthening method of the present invention permits strengthening of existing concrete or masonry walls which have inadequate or no reinforcement, deteriorated over their service lives, or have been damaged as a result of a severe loading, such as caused by an earthquake. In addition, the strengthening method of the present invention can be utilized in the design and construction of improved masonry and concrete walls so as to permit them to be made thinner, stronger, stiffer, and more ductile than masonry and concrete walls of conventional construction. Hereinafter, for the sake of brevity, the term "wall" will be used to refer to either a masonry or concrete wall or the like.

Accordingly, the present invention is directed to a method of strengthening a wall comprising the method of: (a) providing at least one strap of composite material; and (b) fixedly attaching the strap of composite material to the wall portion along at least lengthwise portions of the strap of composite material and opposite end portions thereof. The method further comprises the step of preparing a portion of a surface of a wall to be strengthened. The preparing step includes cleaning the surface portion of the wall.

More particularly, the composite material of the strap is a nonmetallic fiber composite material. The composite material can include glass, carbon, graphite, and synthetic high strength materials. The composite material can be provided in individual strands of material or in multiple strands being weaved together to form a substantially flat tape in which the fibers are oriented in selected ones of longitudinal, transverse and angular directions, and of combinations thereof, relative to a length of the tape to form a desired weave pattern.

Fixedly attaching of the strap to the wall surface portion basically involves bonding the strap of composite material onto the surface portion of the wall. The fixedly attaching step includes impregnating the strap with an epoxy and then applying under pressure the epoxy-impregnated strap onto the wall surface portion. Also, preferably sections of the strap, such as edge portions thereof, are fastened to an adjacent structure which supports the wall being strengthened so as to facilitate transfer of loads from the wall to the adjacent structure.

Another method of strengthening a wall includes the steps of providing a mixture of randomly-oriented short fibers and liquid resin or adhesive matrix and applying the mixture to the surface of the wall. The mixture can be applied either by spraying or troweling the mixture onto the surface of the wall. The liquid resin or adhesive matrix is a material that cures fast so as to prevent the fibers from running with the liquid down the height of the wall surface.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the following figures of the attached drawings in which reference characters refer to the same parts throughout the different views and in which emphasis is placed upon illustrating the principles of the present invention in a clear manner through the depicting of components only in a schematic form and not to any given scale.

DETAILED DESCRIPTION OF THE INVENTION

Figure 1:
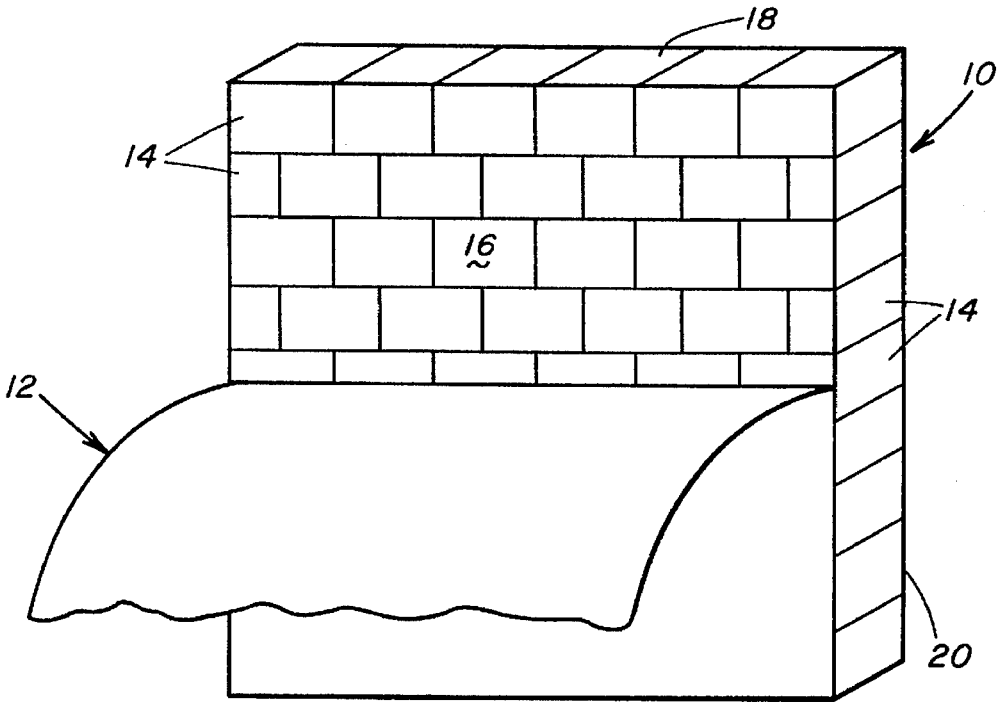
FIG. 1 is a schematic view of a preferred embodiment of a method for strengthening a wall.

Referring now to the drawings and particularly to FIG. 1, there is illustrated a preferred embodiment of a method of strengthening of a wall 10 by applying a strap 12 of composite fabric to it. The wall 10 illustrated can be a small portion of a longer parapet or fence wall or load-bearing wall or any other wall. The wall 10 is typically constructed of multiple brick elements 14 in a stocked relationship which can be made, for example, of solid or hollow brick, hollow clay tile, or concrete block. However, just as readily, the principles of the present invention can be applied to a concrete wall having a one-piece construction. The composite fabric strap 12 may advantageously be attached, preferably by being epoxied, to one surface or face 16 of the wall 10. Further, the composite fabric strap 12 can be extended over the top 18 of the wall 10 and epoxied to the opposite face 20 of the wall 10.

Figure 2:
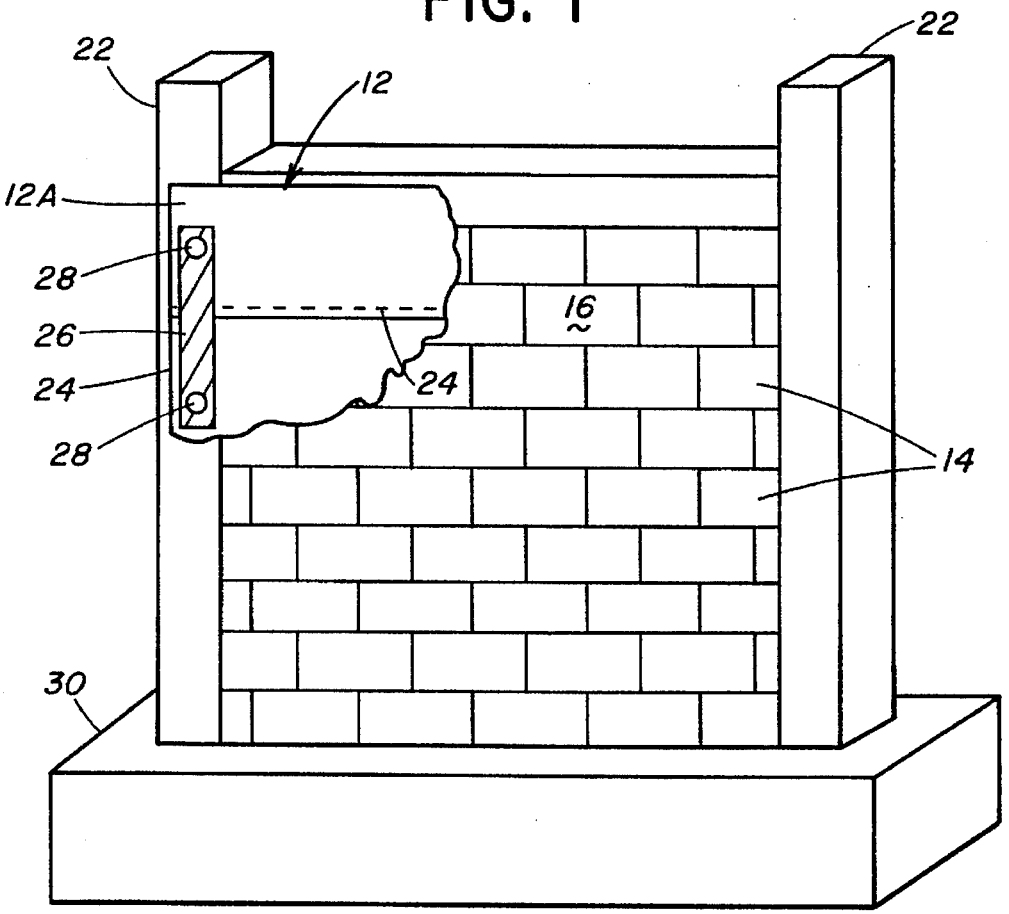
FIG. 2 is a schematic view of a preferred embodiment of a method for strengthening an infill frame.

Referring to FIG. 2, there is depicted another preferred embodiment of the strengthening method wherein the composite fabric strap 12 is applied to an infill frame 22. The composite fabric strap 12 is epoxied onto the surface or face 16 of the brick wall 10. The end portions 12A of the composite strap 12 can be attached to the infill frame 22 by either an epoxy-bonded joint 24 or a steel plate or angle 26 anchored by means of a plurality of fasteners 28, such as bolts, to the frame 22. A similar type of connection can be made between the composite strap 12 and a footing 30.

Figure 3:
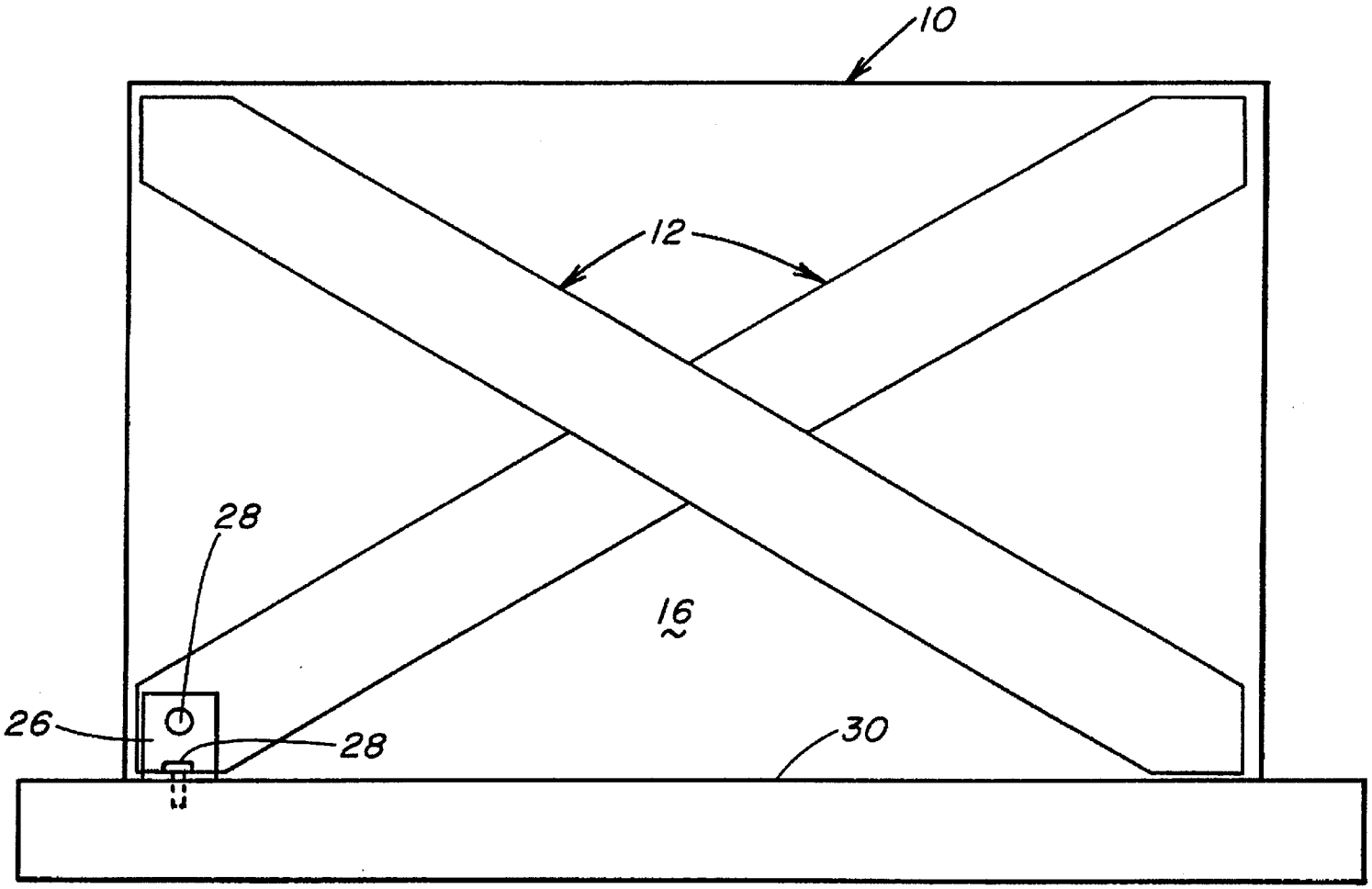
FIG. 3 is a schematic view of another preferred embodiment of a method for strengthening a wall or an infill frame.

Referring to FIG. 3, there is shown another preferred embodiment of the strengthening method wherein criss-crossed composite fabric straps 12 are applied to a wall 10. Each composite fabric strap 12 is attached to the wall 10 preferably by being bonded by means of epoxy to the surface or face 16 of the wall 10. The opposite ends of the straps 12 are anchored to the wall 10 and footing 30 through epoxy joints 24 or by steel plates 26 anchored by bolts 28 as shown in FIG. 3.

Figure 4:
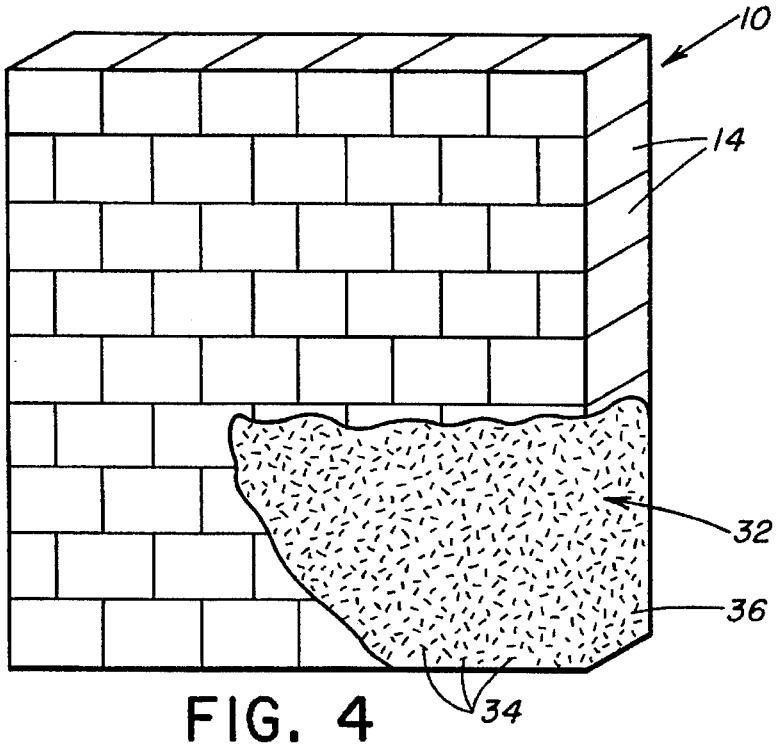
FIG. 4 is a schematic view of still another preferred embodiment of a method for strengthening a wall.
Figure 5:
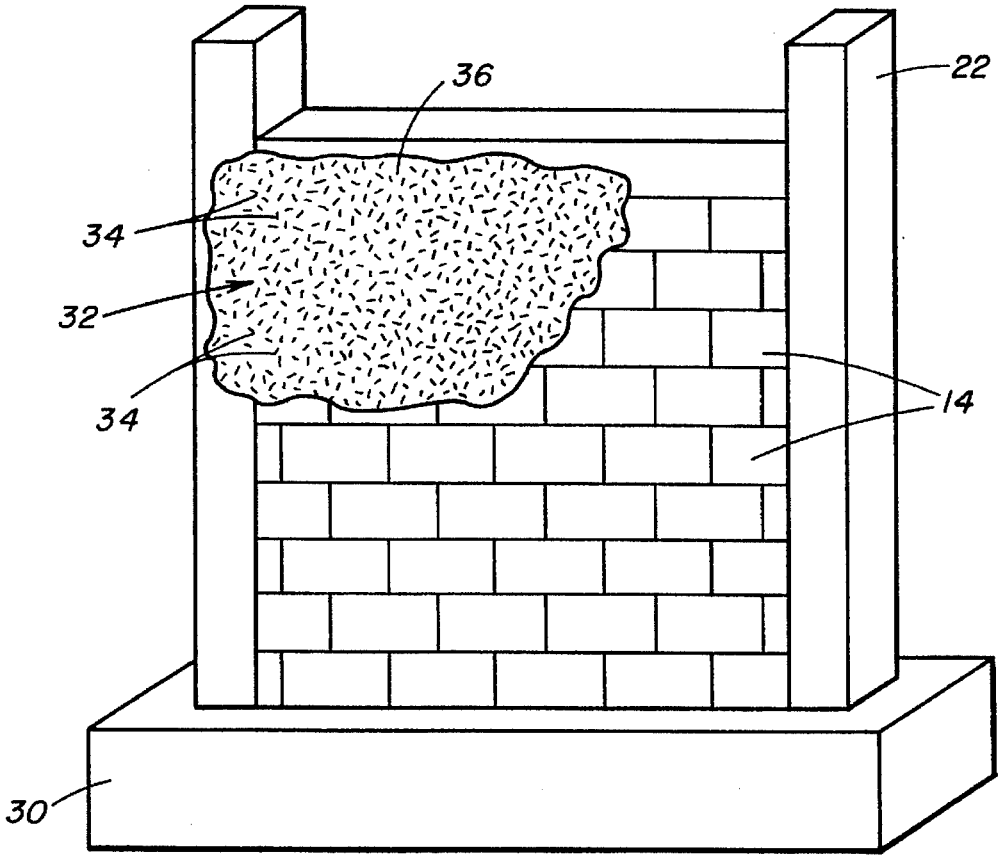
FIG. 5 is a schematic view of still another preferred embodiment of a method for strengthening an infill frame.

Referring to FIGS. 4 and 5, there is illustrated yet another preferred embodiment of the strengthening method wherein a mixture 32 of fibers 34 and a liquid matrix 36 of a material adapted to adhere to the surface or face 16 of the wall 10 is applied to the wall surface 16. The fibers 34 are embedded in the liquid matrix 36 in random orientations. The mixture 32 is applied to the wall surface 16 by use of any suitable technique. One technique that is effective is to spray the mixture 32 on the wall surface 16 using a pump. Another technique that is effective is to trowel the mixture 32 to the wall surface 16. The liquid matrix 36 can be a liquid resin, such as polyesters, vinylesters, etc., or a liquid adhesive, which includes all types of epoxies. Preferably, the liquid resin or adhesive matrix is a material that cures quickly so as to prevent the fibers 34 from running with the liquid down the height of the wall surface 16. One type of material which can be used is a "radiation cured" material. This material uses a specific type of radiation (e.g., ultraviolet or UV, etc.) to quickly turn the epoxy into a jell which will not run with the liquid matrix. As soon as the epoxy is applied, radiation is then applied to the wall and the epoxy turns into a "solid" state within a few seconds.

Also, preferably, the fibers 34 are made of any suitable synthetic nonmetallic material; basically, they are the same fibers from which the fabrics of the earlier embodiments are made. The fibers are very small in cross section (typically about the size of a hair strand) and can vary in length from about ⅛ inch to four inches. The same protective finish/covers as used in the earlier embodiments can be used here.

The strengthening method of the present invention is primarily intended and directed to increasing the strength, stiffness, and ductility of masonry and/or concrete walls 10, irrespective of whether the walls have one-piece or block-type constructions, where the structures are defined as any constructed facility such as buildings, bridges, parking garages, water tanks, pipes, and the like. The present invention employs the following techniques and materials for external reinforcement and confinement of the walls 10.

The techniques involve epoxy-bonding the straps 12 of a strong composite fabric onto the full or partial face of the wall 10. The straps 12 can overlap or they can be separated with a finite distance. The steps to be followed include, but are not limited, to the following:

A. The respective surface 16 of the wall 10 is prepared for strengthening by cleaning the surface, preferably by sandblasting and applying air under high pressure to the surface to remove and eliminate any paint or loose particles and to expose a strong surface adequate for bonding of the straps 12 which could be further prepared by applying a coat of primer to it to enhance the bonding of epoxy.

B. The composite fabric straps 12, are impregnated with an epoxy and placed onto the wall surface 16. A slight pressure may be required to ensure proper bonding of the composite fabric strap 12 to the wall 10.

C. Additional epoxy may be applied to the top (exposed) surface of the strap 12 to ensure full saturation of the composite fabric.

D. The straps 12 of composite fabric can be fastened to the structure at its columns, beams, foundation, etc. using steel plates, angles, bolts, and the like to provide additional security and to facilitate transfer of loads from the new fabric/wall system to the existing structure.

E. If desired, a layer of paint, ultraviolet protection coating, plaster, stucco, etc. can be added to cover the surface of the strengthened wall.

The preferred material for construction of the composite fabric straps 12 are nonmetallic fiber composite materials including, but not limited to, all grades and types of glass, carbon, graphite and synthetic high strength materials, such as Kelvar, Nylon, Dacron and the like. The straps 12 can be in the form of individual strands or strands weaved together to form a generally flexible, tape-like strap of desired width, length, thickness and weave pattern. The fibers can be oriented in the longitudinal, transverse, at an angle, or a combination of these directions along the length of the composite strap to form the desired weave pattern. The flexibility of the strap 12 ensures that it will apply flat on or flush with the contour of the surface 16.

It should be noted that while the figures may show either masonry or concrete walls, the same procedure can be applied interchangeably to both types of walls. Furthermore, if the surface of the wall is covered with an architectural surface or layer such as stucco, the same procedure can be applied over the surface of the stucco. In this case, additional mechanical anchors such as steel bolts can be used at specified intervals on the surface of the wall to enhance the connection of the composite strap to the core of the wall.

Advantages of the Present Invention

The present invention as described above has several advantages over the methods currently used for strengthening of walls 10. Many of these advantages have been confirmed through experimentation and tests carried out by the inventors. These advantages include but are not limited to the following:

1. Increased Flexural Strength—When a wall is subjected to out-of-plane bending, the composite straps undergo tensile stresses. This results in an internal moment couple consisting of the tensile force in the composite strap and a compression force in concrete or masonry. This internal moment can resist the externally applied moment.

2. Increased Stiffness—The combination of composite straps and epoxy have a modulus of elasticity higher than that of masonry or concrete. Therefore, the overall stiffness of the wall is increased.

3. Increased Ductility—Unreinforced masonry has little tensile capacity. Consequently, it fails in a brittle manner (i.e. with little deformation prior to failure). The composite straps allow the wall to undergo very large out-of-plane deflections. The presence of the composite straps confines the wall and prevents the separation of the individual bricks from the wall.

4. Wall Openings—Most walls have windows and openings which introduce difficulties in case of conventional strengthening techniques. Composite straps, on the other hand, can be easily trimmed and cut to preserve the original configuration of the wall.

5. Light Weight—The light weight of the composite straps will greatly simplify the construction and strengthening procedure and cost. The light weight will also result in little addition to the self weight of the structure and will therefore not result in additional forces during an earthquake.

6. Flexibility—Composite straps are generally very flexible and can be wrapped around corners of walls, doors, windows, etc.

7. New Designs—The benefits of external reinforcement with composite straps can also be utilized in new designs. For example, to achieve the same strength, a combination of composite fabric and masonry or concrete results in a thinner wall compared to ordinary reinforced masonry or concrete walls.

It is thought that the present invention and its advantages will be understood from the foregoing description and it will be apparent that various changes may be made thereto without departing from its spirit and scope of the invention or sacrificing all of its material advantages, the form hereinbefore described being merely preferred or exemplary embodiment thereof.

We claim:

1. A method of strengthening a portion of a wall having multiple individual brick elements in a stacked relationship and defining a surface of a given contour, comprising the steps of:

(a) providing at least one strap of composite material;

(b) applying the strap of composite material in a substantially flat condition onto the surface of the wall portion to be strengthened having the multiple individual brick elements in the stacked relationship such that the strap of composite material lies in a substantially flush contacting relationship with the given contour of the surface of the wall portion to be strengthened and holds and confines together the multiple individual brick elements of the wall portion in the stacked relationship; and (c) fixedly attaching the strap of composite material to the wall portion along at least lengthwise portions of the strap of composite material and opposite end portions thereof;

(d) said flush contacting and fixedly attaching of the strap of composite material with said wall portion together forming an internal moment couple in response to application of an external bending moment to the wall portion wherein the flush contacting and fixedly attached strap of composite material will resist tensile force imposed by the bending load while the wall portion will resist compression force imposed by the bending load and thereby strengthen the wall portion which will allow the wall portion to undergo out-of-plane deflections while holding together and confining the individual brick elements so as to prevent their separation from the wall portion.

2. The method of claim 1 further comprising the step of: preparing the surface of the wall portion to be strengthened.

3. The method of claim 2 wherein said preparing includes cleaning the surface of the wall portion to be strengthened.

4. The method of claim 3 wherein said cleaning is performed by applying sandblasting to the surface of the wall portion to be strengthened.

5. The method of claim 3 wherein said cleaning is performed by applying pressurized air to the surface of the wall portion to be strengthened.

6. The method of claim 1 wherein said composite material of the strap is a nonmetallic fiber composite material.

7. The method of claim 6 wherein said material includes glass, carbon, graphite, and synthetic high strength materials.

8. The method of claim 6 wherein said material is provided in individual strands of material.

9. The method of claim 6 wherein said material is provided in multiple strands being weaved together to form a substantially flat tape in which the fibers are oriented in selected ones of longitudinal, transverse and angular directions, and of combinations thereof, relative to a length of the tape to form a desired weave pattern.

10. The method of claim 1 wherein said fixedly attaching includes bonding the strap of composite material onto the surface of the wall portion to be strengthened.

11. The method of claim 1 wherein said fixedly attaching includes impregnating the strap with an epoxy.

12. The method of claim 11 wherein said fixedly attaching includes applying under pressure the epoxy-impregnated strap onto the wall surface portion.

13. The method of claim 11 further comprising the step of:

applying epoxy to a surface of the strap of composite material facing away from the wall surface portion so as to ensure full saturation of the composite material with epoxy.

14. The method of claim 1 further comprising the step of:

fastening a main portion of the strap of composite material to the wall portion of multiple individual brick elements in the stacked relationship and an end portion of the strap of composite material to a structure adjacent to the wall portion being strengthened so as to facilitate transfer of loads from the wall portion to the adjacent structure.

15. The method of claim 14 wherein said fastening includes anchoring the end portion of the strap of composite material by applying anchor fasteners through the strap end portion and into the structure.

16. The method of claim 14 wherein said fastening includes applying a rigid plate over the end portion of strap of composite material being fastened to the structure.

17. The method of claim 16 wherein said fastening includes anchoring the end portion of the strap of composite material by applying anchor fasteners through the rigid plate and strap end portion and into the structure.

18. The method of claim 1 further comprising the step of:

applying a coat of a protective material over the surface of the wall portion strengthened by the strap of composite material.

19. A method of strengthening a portion of a wall having multiple individual brick elements in a stacked relationship and defining a surface of a given contour, comprising the steps of:

(a) preparing the surface of the portion of the wall to be strengthened having the multiple individual brick elements in the stacked relationship;

(b) providing a plurality of straps of flexible nonmetallic fiber composite material;

(c) applying the straps of composite material in substantially flat conditions onto the surface of the wall portion to be strengthened having the multiple individual brick elements in the stacked relationship such that the straps of composite material lies in substantially flush contacting relationships with portions of one another and with the given contour of the surface of the wall portion to be strengthened; and (d) fixedly attaching the straps of nonmetallic fiber composite material to the wall portion along at least lengthwise portions of the straps and opposite end portions thereof;

(e) said flush contacting and fixedly attaching of the straps of nonmetallic fiber composite material with said wall portion together forming an internal moment couple in response to application of an external bending moment to the wall portion wherein the flush contacting and fixedly attached straps of nonmetallic fiber composite material will resist tensile force imposed by the bending load while the wall portion will resist compression force imposed by the bending load and thereby strengthen the wall portion which will allow the wall portion to undergo out-of-plane deflections while holding together and confining the individual brick elements so as to prevent their separation from the wall portion.

20. The method of claim 19 wherein said fixedly attaching includes overlapping adjacent ones of the straps.

21. The method of claim 19 wherein said fixedly attaching includes separating adjacent ones of the straps by predetermined finite distances.

22. The method of claim 19 wherein said preparing includes cleaning the surface of the wall portion to be strengthened.

23. The method of claim 19 wherein said material includes glass, carbon, graphite, and synthetic high strength materials.

24. The method of claim 19 wherein said material is provided in individual strands of material.

25. The method of claim 19 wherein said material is provided in multiple strands being weaved together to form a substantially flat tape in which the fibers are oriented in selected ones of longitudinal, transverse and angular directions, and of combinations thereof, relative to a length of the tape to form a desired weave pattern.

26. The method of claim 19 wherein said fixedly attaching includes bonding the straps onto the surface of the wall portion to be strengthened.

27. The method of claim 19 wherein said fixedly attaching includes impregnating the strap with an epoxy.

28. The method of claim 27 further comprising the step of:

applying epoxy to a surface of the strap of composite material facing away from the wall surface so as to ensure full saturation of the composite material with epoxy.

29. The method of claim 19 further comprising the step of:

fastening a main portion of the strap of composite material to the wall portion of multiple individual brick elements in the stacked relationship and an end portion of the strap of composite material to a structure adjacent to the wall portion being strengthened so as to facilitate transfer of loads from the wall portion to the adjacent structure.

30. The method of claim 29 wherein said fastening includes anchoring the end portion of the strap of composite material by applying rigid anchoring members through the strap end portion and into the structure.

31. A method of strengthening a portion of a wall having multiple individual brick elements in a stacked relationship and defining a surface of a given contour, comprising the steps of:

(a) providing a mixture of fibers and a liquid matrix of material adapted to adhere to the surface of the portion of the wall to be strengthened having the individual brick elements in the stacked relationship and embedding said fibers in random orientations; and (b) applying the mixture of fibers and liquid matrix in a substantially flat condition onto the surface of the wall portion to be strengthened having the individual brick elements in the stacked relationship such that the mixture of fibers and liquid matrix adheres to and cures in a substantially flush contacting relationship with the given contour of the surface of the wall protion to be strengthened so as to allow the wall portion to undergo out-of-plane deflections while holding together and confining the individual brick elements so as to prevent their separation from the wall portion.

32. The method of claim 31 further comprising the step of:

preparing the surface of the wall portion to be strengthened.

33. The method of claim 32 wherein said preparing includes cleaning the surface of the wall portion to be strengthened.

34. The method of claim 31 wherein said applying is carried out by spraying the mixture onto the surface of the wall portion to be strengthened.

35. The method of claim 31 wherein said applying is carried out by troweling the mixture onto the surface of the wall portion to be strengthened.

36. The method of claim 31 wherein said liquid matrix of material adapted to adhere to a surface of a wall portion to be strengthened is a liquid resin.

37. The method of claim 31 wherein said liquid matrix of material adapted to adhere to a surface of a wall portion to be strengthened is an adhesive matrix.

38. The method of claim 31 wherein said liquid matrix is a material that cures fast so as to prevent the fibers from running with the liquid matrix down the height of the wall surface.

39. The method of claim 31 wherein said fibers have lengths ranging from ⅛ inch to four inches.

40. The method of claim 31 wherein said fibers are made of a material which includes glass, carbon, graphite, and synthetic high strength materials.

* * * * *